US007784840B2

(12) United States Patent
Leslie

(10) Patent No.: US 7,784,840 B2
(45) Date of Patent: Aug. 31, 2010

(54) APPARATUS AND METHOD FOR LUBRICATING RAILROAD TRACKS

(76) Inventor: Carlton Leslie, 4340 Cross St., Downers Grove, IL (US) 65151

( * ) Notice: Subject to any disclaimer, the term of this patent is extended or adjusted under 35 U.S.C. 154(b) by 428 days.

(21) Appl. No.: 11/678,815

(22) Filed: Feb. 26, 2007

(65) Prior Publication Data

US 2008/0203735 A1 Aug. 28, 2008

(51) Int. Cl.
*B60B 39/00* (2006.01)

(52) U.S. Cl. ..... 291/3

(58) Field of Classification Search ..... 291/2, 291/3, 22, 23, 24
See application file for complete search history.

(56) References Cited

U.S. PATENT DOCUMENTS

| | | | | |
|---|---|---|---|---|
| 1,386,426 | A | | 8/1921 | Riddle |
| 1,709,095 | A | | 4/1929 | Protzeller |
| 2,285,082 | A | | 6/1942 | Bolt |
| 2,718,280 | A | | 9/1955 | Hurrell |
| 2,814,422 | A | | 11/1957 | Mercier |
| 2,929,466 | A | | 3/1960 | McWilliams |
| 3,051,262 | A | | 8/1962 | Bettison |
| 3,059,724 | A | | 10/1962 | Soule |
| 4,198,164 | A | | 4/1980 | Cantor |
| 4,214,647 | A | | 7/1980 | Lutts |
| 4,230,045 | A | | 10/1980 | Fearon |
| 4,245,719 | A | | 1/1981 | Frank |
| 4,334,596 | A | | 6/1982 | Lounsberry |
| 4,346,785 | A | | 8/1982 | Frank |
| 4,393,957 | A | | 7/1983 | Hawthorne |
| 4,520,901 | A | | 6/1985 | Borup |
| 4,711,320 | A | | 12/1987 | Dombroski |
| 4,726,448 | A | | 2/1988 | Schroeder |
| 4,856,617 | A | * | 8/1989 | Lounsberry et al. ..... 184/3.1 |
| 4,930,600 | A | | 6/1990 | Kumar |
| 5,080,195 | A | | 1/1992 | Mizumoto et al. |
| 5,129,606 | A | | 7/1992 | Rodems |
| 5,186,280 | A | | 2/1993 | Mattcheck |
| 5,477,941 | A | | 12/1995 | Kumar |
| 5,492,642 | A | | 2/1996 | Mulvihill |
| 5,687,814 | A | | 11/1997 | Craig et al. |
| 5,842,543 | A | | 12/1998 | Naito |
| 5,896,947 | A | | 4/1999 | Kumar |
| 6,076,637 | A | | 6/2000 | Kumar |
| 6,170,594 | B1 | | 1/2001 | Gilbert |
| 6,170,610 | B1 | | 1/2001 | Kumar |

(Continued)

*Primary Examiner*—S. Joseph Morano
*Assistant Examiner*—Robert J McCarry, Jr.
(74) *Attorney, Agent, or Firm*—C. John Brannon; Brannon & Sowers PC

(57) ABSTRACT

A system for increasing the efficiency of the movement of a railroad car over a length of rail, including a fluid reservoir for containing a quantity of efficiency enhancing fluid, a fluid dispensing member, a fluid pump connected in fluidic communication between the reservoir and the fluid dispensing member for dispensing a predetermined quantity of fluid through the fluid dispensing member, a microprocessor operationally connected to the fluid pump, and a first sensor for generating a first sensor signal in response to a railroad car crossing a predetermined section of track and operationally connected to the microprocessor. The fluid dispensing member is positioned along a railroad portion substantially equal in length to the circumference of a railroad car wheel to provide a substantially continuous flow of efficiency enhancing fluid substantially equal in length to the circumference of a railroad car wheel onto the rail portion when the predetermined quantity of fluid is dispensed.

2 Claims, 8 Drawing Sheets

U.S. PATENT DOCUMENTS 6,199,661 B1 3/2001 Kumar
6,446,754 B1 * 9/2002 Kostelny-Vogts et al. .... 184/3.1
6,578,669 B2 6/2003 Kast et al.
6,585,085 B1 * 7/2003 Kumar ..... 184/3.2
2003/0111295 A1 6/2003 Kumar et al.

* cited by examiner

APPARATUS AND METHOD FOR LUBRICATING RAILROAD TRACKS

CROSS-REFERENCE TO RELATED APPLICATIONS

The present application is a utility application claiming priority to, and based upon, co-pending U.S. patent application Ser. No. 11/125,986, filed May 10, 2005, which claims priority to then co-pending U.S. Provisional Patent Application No. 60/569,524, filed May 10, 2004; to co-pending U.S. patent application Ser. No. 11/245,293, filed Oct. 6, 2005 and claiming priority to co-pending U.S. patent application Ser. No. 11/021,448, filed Dec. 23, 2004 and claiming priority to then U.S. patent application Ser. No. 10/238,451, filed Sep. 10, 2002, now abandoned, and claiming priority to then U.S. patent application Ser. No. 09/633,390, filed Aug. 7, 2000, which issued on Sep. 10, 2002 as U.S. Pat. No. 6,446,754; and to co-pending U.S. patent application Ser. No. 11/021,448, filed Dec. 23, 2004 and claiming priority to then U.S. patent application Ser. No. 10/238,451, filed Sep. 10, 2002, now abandoned, and claiming priority to then U.S. patent application Ser. No. 09/633,390, filed Aug. 7, 2000, which issued on Sep. 10, 2002 as U.S. Pat. No. 6,446,754.

TECHNICAL FIELD

The present specification relates to increasing the efficiency of rail travel, such as through the removal of obstacles, such as ice, friction, or the like, from railroad tracks and, in particular, to an improved method of controlling the amount of obstacle removal treatment applied to the railroad tracks.

BACKGROUND

It is well known that the application of a lubricant to the surfaces of railroad tracks improve the rollability of railroad cars thereby significantly reducing the rate at which the tracks become worn by the wheels of the cars as they engage the tracks. Track portions such as curves and switches are particularly subject to wear. Lubricating the tracks likewise reduces the wear to the wheels of the cars.

The cars of a train are disassembled and reassembled into new trains in a yard which has numerous parallel tracks that are accessible from the opposing ends thereof by access tracks connected by switches. The track, including curves and switches, are currently lubricated by manually applying lubricant thereto or by injecting a lubricant, such as through outlets on to the surface of the tracks.

Within the yard, cars of an incoming train are disassembled and recombined with cars from other incoming trains into a plurality of new outgoing trains, with the cars of each new train lined up on a separate track in the yard. A hump yard is a switchyard wherein a locomotive pushes cars over a hump at a speed of approximately three miles per hour. The car is independently released on the crest of the hump and allowed to roll down the far side of the hump and across switches to tracks on which the new trains are being formed. Another type of switchyard is a flat switching yard, where a locomotive is used to push cars all the way to a desired location.

In a hump yard, the speed of the car as it moves along the track system is controlled by a series of retarders. A computer associated with each retarder receives information regarding the weight of the incoming car and has a sensor for determining the speed at which the car is entering the retarder. The computer compares the weight and speed of the incoming car with its desired speed and calculates and applies the appropriate braking force to achieve a predetermined exit speed for the car. The computer also maintains a count of the number of cars being directed to each yard track and is able to adjust the application of the retarder based on the incoming speed, the weight of the approaching car and the space remaining on the yard track. Other sensors in the system follow the car's progress across the switches of this system in conjunction with a signal system and prohibit the premature throwing of a switch along the path of a rolling railroad car. Except for speed and weight, the retarders of a hump yard system are not responsive to the condition of an individual car or to the condition of the track.

The dispensers now being used to lubricate the tracks of a yard system have an associated detector for detecting when a car is approaching; the dispenser may be adapted to dispense a fixed amount of lubricant each time a car passes. When the tracks are properly lubricated, a railroad car that does not have its brake applied and is free of defects will move along the tracks of the system at a predictable rate. In reality, however, several factors affect the amount of lubricant needed to maintain the optimum rollability of cars over the tracks. Excessive lubrication will cause lubricant to build up on the yard tracks. Excess lubricant is undesirable insofar as it poses a hazard to railroad personnel, can cause roll out, can cause damage to the cars and the contents thereof, and generally contaminates the underlying ground.

Water is a natural lubricant and, therefore, a lesser amount of lubricant is needed on the tracks during rain or snow. On the other hand, rain or snow will wash some of the newer 'friction modifier' lubricants off the tracks, leaving the tracks in need of restoration of the desired level of lubrication after the rain has ended. Cars moving along the tracks of an adequately lubricated yard system will lose speed at a predictable rate thereby allowing the orderly assembly of the cars on the yard tracks. On the other hand, the cars move more slowly along inadequately lubricated tracks, as occurs following a rain storm, slowing down the disassembly/reassembly process and costing time and money.

Lubricant which is dispensed on the track is picked up by the wheels of a moving railroad car and spread down the track. Once a few cars have applied lubricant to a previously underlubricated section of track, the cars will again be able to move at their desired speeds, after which only intermittent application of lubricant are needed to maintain adequate lubrication. It is unnecessary, therefore, to apply lubricant to the tracks each time a car is released over a hump, as currently is the practice in most hump yards.

In the case of the flat switching yard, lubrication is typically sparsely applied by manual application, since excess lubrication makes it difficult for locomotives towing or pushing other cars to gain and maintain traction. Known automated lubrication systems, such as those that rely on timing or 'car counting' to schedule lubricant delivery onto the tracks, are largely ineffective in flat switching yard applications, since they tend to over-lubricate the tracks with uncontrolled amounts of lubricant and thus interfere with the operation of the locomotive.

Moreover, the formation of ice and the accumulation of snow on railroad track components, such as switches, can cause significant operating problems. Historically a common method of addressing this has been through the use of heat, typically applied as a gas-fired flame, manually invoked. Because of this manual initiation, the heat is typically applied continuously once invoked until manually shut off. This is inefficient for several reasons. First, a determination as to the need for de-icing has to be made; this determination is usually made subjectively. Second, a manual step is required to ignite the 'heaters'. Third, because of its "brute force" nature, much of the heat energy is simply dissipated rather than being used more efficiently on the need-affected area. Forth, because of the manual steps needed to ignite these different areas the flames are often left running when the need is not currently present but may recur within a time frame soon enough to make the on/off cycle costly to employ. Alternatively, the use of electric resistance heating in lieu of gas-fired flame can be employed but some of the same inefficiencies still persist.

Alternately, chemical antifreeze or deicing agents are sometimes applied to prevent the buildup of ice and snow over and around railroad switches; this practice has met with some success. Such agents are typically manually applied to problem areas, such as by men with hand-held sprayers. This technique is typically used to address acute problems, such as already-frozen or iced-up switches that have already caused problems and will have to be manually cleaned and/or deiced, and as such is reactive in nature. This technique suffers the drawbacks of being time consuming, since the laborers must be called, equipped, and sent to the problem areas in response to weather conditions once those conditions have arisen and been identified. Such a response is inefficient in terms of both time and expense lost.

While lubrication and lubrication control is important in the switchyard setting, it is likewise important for railroad tracks spanning the countryside. The need for lubrication is perhaps greatest at curves because lateral forces are applied to the gauge face of the track by the side of the wheels as the train travels through the curve. The application of lateral forces increases friction and wear (both to the wheels and to the track) and the curved track wears far more rapidly than straightaway track. Not only do the tracks wear more rapidly at curves, the lateral forces applied thereto from the wheels of the train moving therethrough can cause the rail to become loosened from the ties. As the rails become loosened, the gauge, or spacing between the rails, may widen and/or, eventually, the track may roll over, resulting in the derailment of a train.

Thus, a need persists for a means of quickly and efficiently measuring the need for a lubrication and/or deicing agent on railroad tracks and then controlling the application of lubricant/deicer in response to the measured need while monitoring the gauge of the rail. The present technology addresses this need.

SUMMARY

The present claimed technology relates to increasing the efficiency of railroad cars moving over rails. One way of increasing the efficiency of rail travel is by sensing the temperature/humidity/dew point and other factors needed for determining if de-icing of railroad track components is required and then automatically causing selective de-icing of these components is described. Another involves optimizing rail lubrication in switchyards and on all tracks.

One object of the present claimed technology is to provide an improved method and apparatus for increasing the efficiency of rail travel. Related objects and advantages of the present claimed technology will be apparent from the following description.

BRIEF DESCRIPTION F THE DRAWINGS

DETAILED DESCRIPTION OF THE PREFERRED EMBODIMENT

Figure 1:
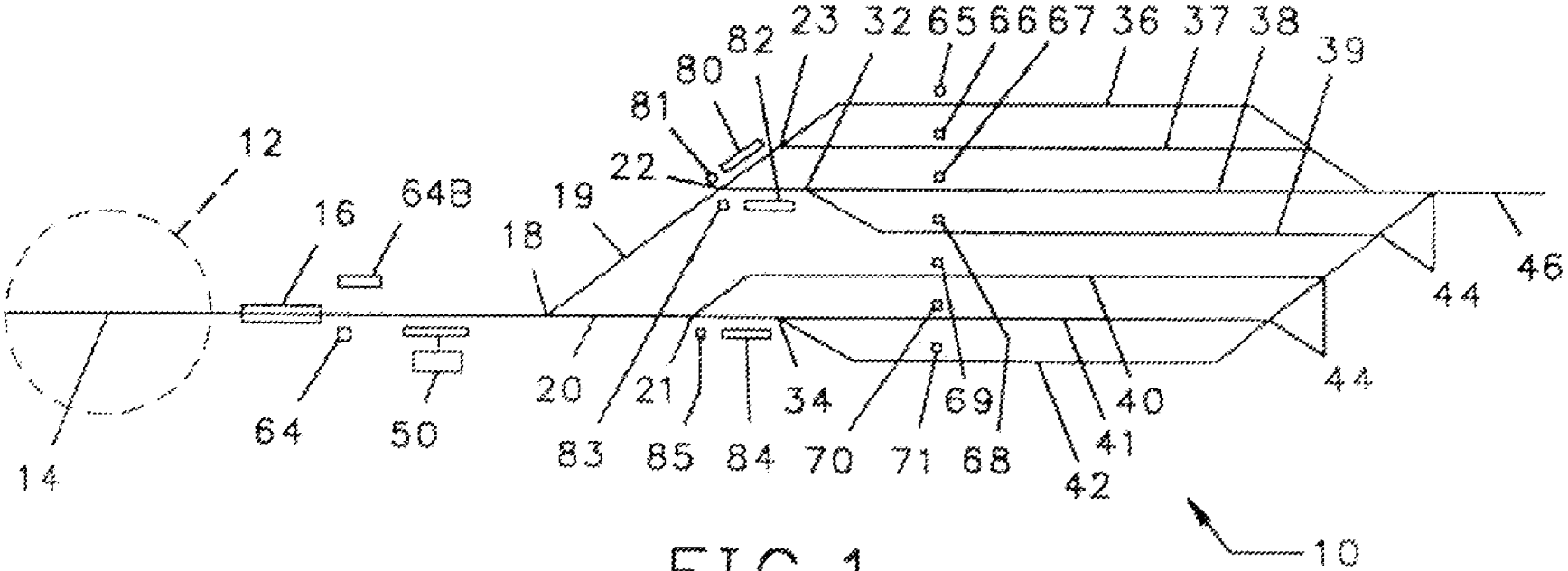
FIG. 1 is a schematic view of the tracks of a yard rail system.

For the purposes of promoting an understanding of the principles of the claimed technology and presenting its currently understood best mode of operation, reference will now be made to the embodiments illustrated in the drawings and specific language will be used to describe the same. It will nevertheless be understood that no limitation of the scope of the claimed technology is thereby intended, with such alterations and further modifications in the illustrated device and such further applications of the principles of the claimed technology as illustrated therein being contemplated as would normally occur to one skilled in the art to which the claimed technology relates.

Referring to FIGS. 1-4, a typical hump yard type switchyard system 10 includes a hump 12, across which is a feeder track 14. It should be appreciated that although the following discussion is directed toward the conditions present in a hump yard-type switchyard, the same novel technologies may be applied to a flat switching yard (i.e., a yard using locomotives to move cars instead of gravity as mediated by humps and inclines) or any other trainyards. Feeder track 14 passes a first retarder 16 after which there is a first switch 18 for dividing the track 14 into two track portions or segments 19, 20. Following the first switch 18 are secondary switches 21, 22, 23, and following the secondary switches 21, 22, 23 are secondary retarders, not shown. Following the secondary retarders are further switches 32, 34 which ultimately break the lines down to yard tracks 36, 37, 38, 39, 40, 41, 42. At the far end of the yard is a second plurality of switches 44 leading to an exit lead 46 across which the assembled trains may be withdrawn and lubricated. An incoming train is typically broken up by releasing cars over the hump 12 and allowing them to roll down the feeder track 14 and into the yard tracks 36-42.

The retarder 16 typically includes a computer (not shown) that receives input from one or more sensors 64A,B, such as from a speed detector 64A and from a scale or weight detector 64B that categorizes the weight of the car. Using these two pieces of information and a look-up table stored in its memory, the computer may adjust the resistant force applied by the retarder 16 to the wheels of the car. If a railroad car is not defective, the car will be moving at the optimum speed when it leaves the retarder 16 and it will move at a predictable speed down track to its destination, provided the track has been properly lubricated, typically on both the top and the gauge face, if necessary, such as on curves. On the other hand, if the car is defective, such as because the brake is being applied when it shouldn't be applied (i.e., the brake is sticky), because the bearings of the wheels are worn, or the like, the car will leave the retarder 16 at a significantly slower speed than the optimum speed and its progress as it moves through the yard will be noticeably below the predicted speeds.

In other configurations, the sensors 64A,B may detect moisture, temperature, ice, sonic pitch, speed, electromagnetic field, combinations thereof and the like.

It should also be appreciated that a since defective car will leave the retarder 16 at a significantly slower speed than the optimum speed, the noticeably slow moving car can be detected and identified by the first sensor 64. Since defective cars will also move through the system at a noticeably slower rate of speed, defective cars are therefore identifiable by their reduced speed after leaving the retarder 16.

When an entire train is assembled on a yard track, the switches 44 at the output end of the bowl are reconfigured to withdraw the assembled train out the exit lead 46 and are also lubricated by the present system 10 as the train leaves the yard.

A treatment station 50 is located behind the first retarder 16 on the feeder track 14. The treatment station 50 has a supply tank 52, a pump assembly 54 for ejecting efficiency enhancement material (fluid), such as lubricant and/or deicer, in the supply tank 52 onto the track (either onto the top, the gauge face, or both), a motor 56 for operating the pump assembly 54, and a network of feeder lines 58 for directing efficiency enhancement material to dispensing member 60. The efficiency enhancement fluid is typically a liquid and more typically includes a deicing agent and/or a lubricant, but may also be a nonliquid, such as a vapor, mist or gas. The system 10 may employ a plurality of different types of efficiency enhancement materials (such as lubricants for different operating conditions, track portions [i.e. top or gauge face], advanced lubricants [such as friction modifiers], deicing agents, or the like) and thus multiple tanks 52 may be employed, or one tank 52 having a plurality of compartments for the respective different efficiency enhancement materials. The station 50 typically further includes a power source 59 operationally connected to the pump assembly 54, and more typically to the motor 56, to provide power to energize the motor 56/pump assembly 54. The power source 59 may be line power, such as from the local grid, or any other convenient power generation means, such as a generator, a battery, a solar panel, a transducer for transducing some of the kinetic energy of a moving rail car into electricity, combinations thereof, or the like. More typically, a back-up or auxiliary power source 61 is electrically connected to the pump assembly 54/motor 56 to provide an uninterrupted power supply in the event the first power source 59 is disabled. The auxiliary power source 61 may likewise be a generator, battery, solar panel, transducer, or the like.

The dispensing member 60 is typically one or more nozzles, but may be an array of nozzles, one or more elongated dispensing members (blades), one or more wiper bars, one or more misters, one or more sprayers, one or more rollers, combinations of the above, or the like. An electronic controller or microprocessor 62 typically controls the operation of the motor 56 and thereby regulates the discharging of efficiency enhancement material through the nozzles 60. The microprocessor 62 receives input from a first sensor 64A which detects the speed of a car approaching the treatment station 50, from the weight sensor 64B, and, more typically, from a plurality of secondary detectors 65, 66, 67, 68, 69, 70, 71, each of which is typically positioned on one of the yard tracks 36, 37, 38, 39, 40, 41, 42, respectively.

Figure 2:
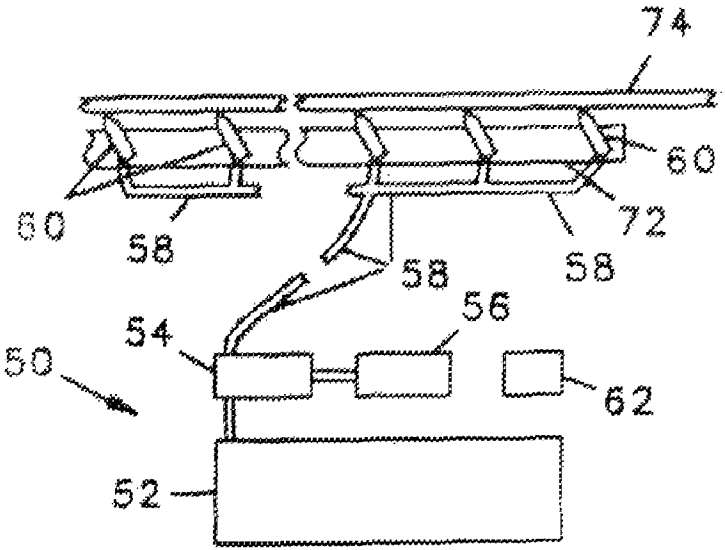
FIG. 2 is a top view of the nozzles of a dispensing system for dispensing lubricant positioned on a track in the yard system shown in FIG. 1.
Figure 3:
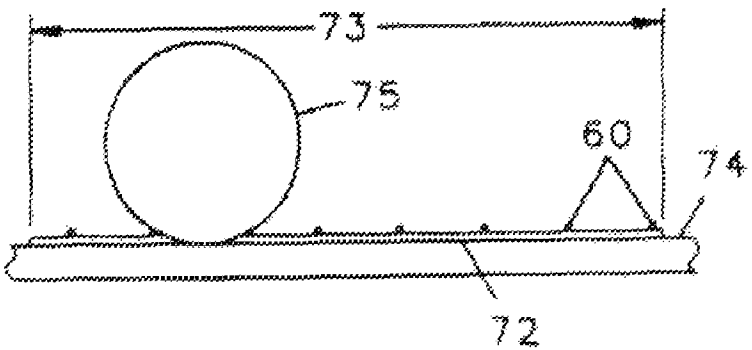
FIG. 3 is a schematic side view of the nozzles and dispensing system shown in FIG. 2 with the wheel of a railroad car rolling thereon.

As seen in greater detail in FIGS. 2 and 3, the dispensing system typically includes two mounting bars 72, one positioned along the inner surface of each of the rails of a track 74. Positioned along the length of each of the mounting bar 72 are the nozzles 60 which are of a type known in the art for dispensing lubricants. Each mounting bar 72 typically has a length 73 which is approximately equal to the circumference of a typical rail car wheel 75 so that lubricant dispensed through the nozzle 60 on the mounting bar 72 will lubricate the entire circumference of the wheel 75 as it rolls across the lubricated portion of track 74. The wheels of the railroad car will then transport the lubricant(s) down the feeder track 14 to the selected yard track into which the car is directed.

The claimed technology requires that the nozzles 60 be positioned sufficiently close to one another and that the pump assembly 54 eject an adequate amount of efficiency enhancement material on each application to apply a continuous path of efficiency enhancement material(s) along the entire length 73 of the track 74. It should be noted that the viscosity and other properties of the efficiency enhancement material change with temperature; thus, the amount of efficiency enhancement material being applied by the nozzles may be temperature dependent in some pump systems. Thus, the pump assembly 54 should be adapted to supply a constant amount of efficiency enhancement material independent if the temperature of the efficiency enhancement material, pump assembly 54 and/or tracks such that the desired amount of efficiency enhancement material(s) will be ejected through the nozzles 60 on each application. One type of pump assembly 54 adequate for the job is a positive displacement pump. Another type of pump assembly 54 adequate for the job is a efficiency enhancement material reservoir located such that it is pressurized by the displacement of the tracks as the train passes over them and connected to the nozzles 60 via solenoid switches (not shown) wherein the switches are controlled by the microprocessor 62.

Typically, the efficiency enhancement material is evenly applied along the length 73 of the track 74. However, the nozzles 60 of a dispensing system can become damaged from debris carried by the moving cars or the like and thus may partially restrict the flow of efficiency enhancement material passing therethrough. If they are all linked together, the nozzles 60 may not dispense the efficiency enhancement material evenly on the track. To better ensure that the efficiency enhancement material is evenly applied along the length 73 of the mounting bar 72, each nozzle 60 has an associated valve 76. The valves 76 are sequenced, such that each valve 76 is successively independently opened. All the efficiency enhancement material dispensed by the pump assembly 54 will then pass through only one nozzle 60 at a time, thereby ensuring that each nozzle 60 will dispense a substantially equal amount of efficiency enhancement material. The efficiency enhancement material is typically a liquid, but may alternately be any convenient lubricant and/or deicing agent, such as water, grease, 'friction modifier'-type, polymer, suspension, stick-type, gel, paste or the like. The efficiency enhancement material may be applied to the top of the rail, the gauge face, or to the top and gauge face concurrently.

Figure 4:
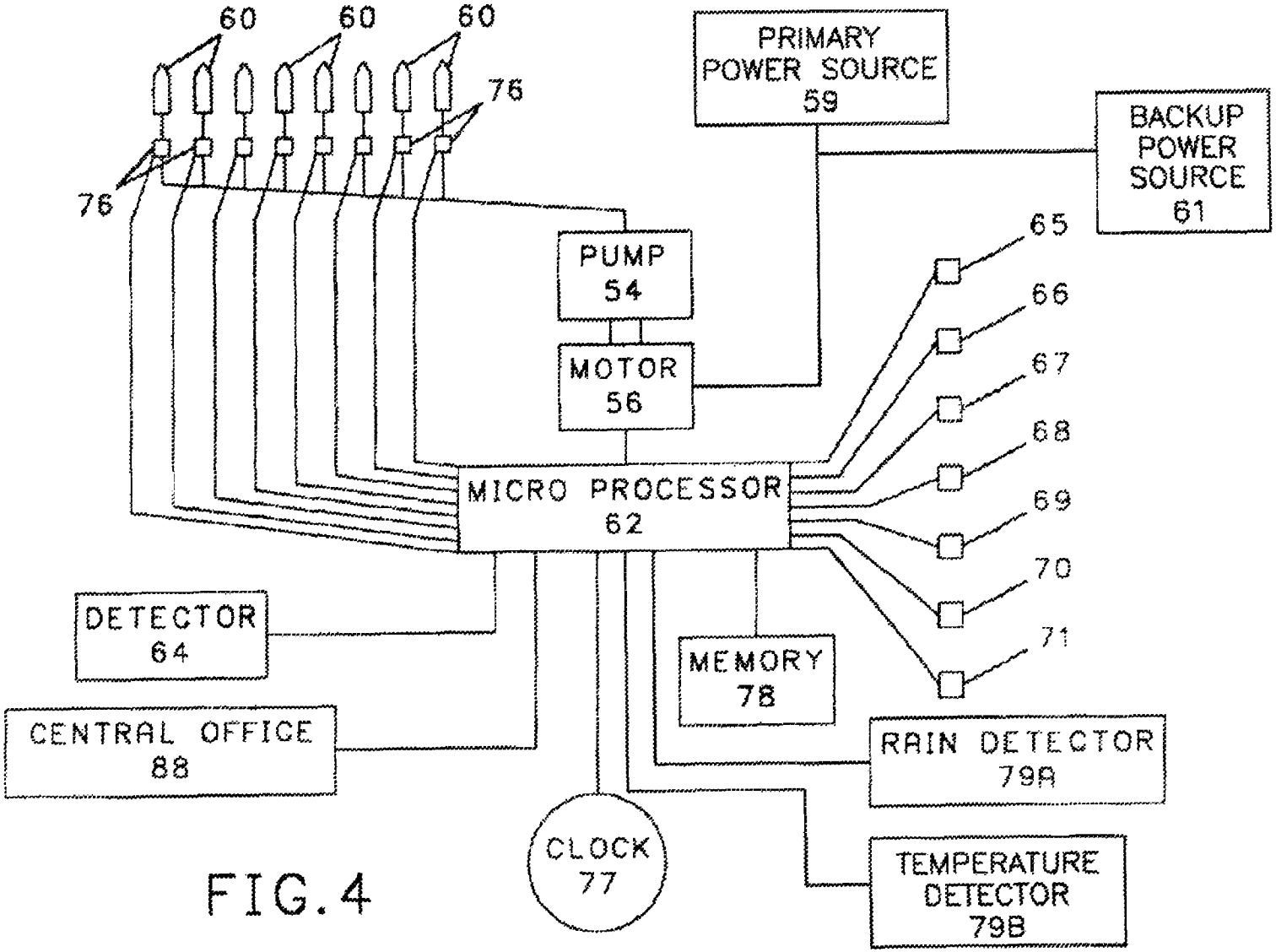
FIG. 4 is a schematic diagram of the feedback system for controlling the dispensing of lubricant through the nozzles shown in FIG. 2.

Referring further to FIGS. 1 and 4 as a moving railroad car reaches the associated yard track 36, 37, 38, 39, 40, 41, 42, the car will pass over the associated detector 65, 66, 67, 68, 69, 70, 71, which each send a signal to the microprocessor 62 designating the arrival time of the car. The microprocessor 62 includes a clock 77 and a memory 78, and the microprocessor 62 will divide the time that has elapsed from when the car crossed the first detector 64 to when it arrived at the secondary detector by the distance traveled to calculate an average speed for the car. If the average speed of a car entering a yard track 36-42 is below a first predetermined desired speed stored in the memory 78 of the microprocessor, but is not excessively slow (i.e., below a second, lower predetermined speed), the microprocessor 62 will direct power to the motor 56 for operating the pump assembly 54 and apply efficiency enhancement material to the track when the wheels 75 of the next railroad car approaches the station 50. If the microprocessor 62 determines that the cars are rolling at the desired speed, it will not direct power to the motor 56 when the next railroad car approaches thereby controlling the further lubrication of the tracks. Alternately, the microprocessor 62 may be programmed to use the input information from the sensors 65, 66, 67, 68, 69, 70, 71 to count cars and dispense efficiency enhancement material to the track each time a predetermined number of cars passes thereby.

The microprocessor 62 is also responsive to a moisture or rain detector 79A operable to detect when the tracks in the system are being lubricated by rain or snow. It is not necessary to lubricate wet tracks because water is an adequate lubricant. Accordingly the computer 62 is typically programmed to ignore readings from the detectors while the rain detector indicates the tracks are wet. The rain may, however, wash other lubricant off the tracks, and therefore the computer 62 will typically initiate new calculations to determine track lubrication as soon as the tracks dry. The microprocessor 62 will therefore energize the motor 56 on information detected after the tracks have dried that show that cars are moving below the desired speeds. The microprocessor 62 will also detect the presence of a potentially defective railroad car and notify the central office as is further described below. Further, the microprocessor 62 may be connected to a weather station (either locally dedicated or remotely located, such as a weather satellite or a weather information network) and may therefore vary the time intervals, amounts, track positions, track portions and/or types of lubricant applied to the tracks in predetermined manners in response to measured weather conditions. A temperature detector 79B is typically likewise positioned to measure track temperature and report the same to the microprocessor 62 this temperature data may be used by the microprocessor along with the moisture data to calculate when the tracks are likely icy. when the microprocessor determines that the tracks are icy, it will typically initiate periodic applications of deicing agent to further increase the efficiency of the track.

Referring to FIG. 1, the claimed technology further includes secondary treatment stations 80, 82, 84 positioned after switches 18, 21, and 22 and prior to switches 23, 32, and 34. Each of the secondary treatment stations 80, 82, 84 has a supply tank, a motor, a pump assembly, nozzles and a microprocessor (all not shown) similar to those described with respect to the primary treatment station 50, and each has a detector 81, 83, 85, respectively, associated therewith. Like the first detectors 64A, B of the primary station 50, the detectors 81, 83, 85 of the secondary stations 80, 82, 84 are positioned immediately before the associated secondary station and signal the station when a railroad car is approaching. Each secondary station 80, 82, 84 receives additional input only from the detectors which are located down track of the station. That is, station 80 receives input only from detectors 65, 66, station 82 receives input only from detectors 67, 68, and station 84 receives input only from detectors 70, 71.

The secondary stations 80, 82, 84 provide efficiency enhancement material to only a portion of the track system 10 and not to the entire system as does the primary station 50, and are activated only after the computer 62 of the primary treatment station 50 determines that the access tracks are already efficiency optimized (i.e., deiced and/or adequately lubricated). For example, if a number of cars have been directed down tracks 14 and 19 to yard tracks 65 and 66, the entire length of this portion of the system will have become lubricated as a result of the lubricant dispensed from the primary station 50. The cars directed to yard tracks 65 and 66 would then be rolling at the desired average speed and the station 50 would not be applying lubricant to the racks. If cars are subsequently directed to yard tracks 67 and 68, and these cars are found to have an average speed less than the desired speed, the loss in speed would presumably be due to inadequate lubrication of yard tracks 67 and 68. In this event the microprocessor 62 of the primary station 50 will not direct power to the motor 56 to further lubricate the tracks. The microprocessor of the secondary station 82, however, will measure the time required for a car to pass from the detector 83 associated with the station 82 to the down track detectors 67 and 68. If this microprocessor determines that these cars are not moving at the desired speed, it will direct power to the associated motor and the secondary station 82 will commence lubricating the tracks prior to the passing of each railroad car. The secondary station will continue to dispense lubricant to the tracks until the cars are again rolling at the desired speed, after which the secondary station 82 will stop lubricating the tracks prior to the passage of a railroad car.

As can be seen, the presently claimed technology provides feedback from down track of the speed of the railroad car. Where the speed of the car is below a predetermined speed, the treatment stations 50, 80, 82, 84 will dispense lubricant on the track 74 immediately before the arrival of the next railroad car. The rolling cars will pick up the lubricant on the wheels thereof and apply it to the track as they move. The system will continue to dispense a fixed amount of lubricant on the tracks prior to the passing of a railroad car until the microprocessors 62 of the various stations determine that the cars are rolling at speeds consistent with lubricated tracks, after which the microprocessors 62 will terminate the dispensing of lubricant.

Referring to FIG. 4, another feature of the present claimed technology is the identification of potentially defective cars. It is far more expensive to deal with a defective car after it has been incorporated into a moving train than to repair the car while it is still in a yard. When the microprocessor 62 associated with one of the various stations 50, 80, 82, 84 determines that a car passing the detector 64 is moving at either an excessively high speed or an exceptionally slow speed, the microprocessor 62 will identify the car as defective and will not energize the associated motor 56 to eject lubricant on the tracks in the path of the car. The microprocessor 62 will also ignore all information from the various sensors triggered by the car in determining whether lubrication and/or deicing is needed for succeeding cars, thereby avoiding erroneous information into its calculations. Finally, the microprocessor 62 will notify the central office 88 of an exceptionally slowly moving car that may be defective.

Figure 5:
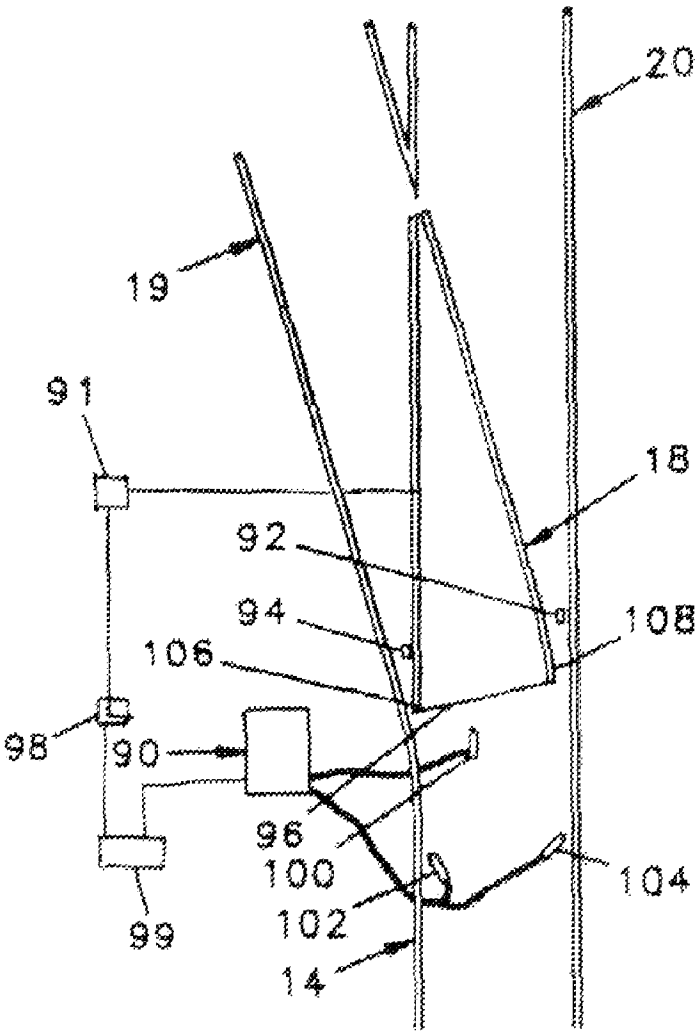
FIG. 5 is a schematic view of a lubricating system for the switch plate of a switch.

Referring to FIG. 5, the claimed technology further includes a station 90 positioned at each switch 18, 21, 22, 23, 32, 34 of which switch 18 is exemplary of all such switches 18, 21, 22, 23, 32, 34. The switch plates and the switch points of a railroad system are especially subject to wear, but currently, no effort is made to automatically apply lubricant or deicing agent to these portions of existing yard systems. There is also a need to lubricate and device the switches that are not part of a yard system.

The station 90 includes a reservoir, a pump, such as a positive displacement pump or the like, a motor and a microprocessor (none of which are shown) similar to those discussed with respect to primary treatment station 50. The station 90 also has first and second detectors 92, 94 for detecting whether the switch plate 96 of the switch 18 is locked to direct a moving car down track 19, or is locked to direct a moving car down track 20. The detectors 92, 94 may be configured to monitor the power and/or voltage required to switch the track and signal for the dispensement of efficiency enhancement material when the power/voltage drawn exceeds a predetermined threshold. Further, the detectors 92, 94 nay be configured to monitor both temperature and power/voltage drawn and to signal for disbursement of a deicing efficiency enhancement material when excessively drawn power/voltage increases with decreasing temperature below the freezing point of water. In other words, deicer is dispensed when the sensors indicate more power is required because it is becoming harder to move a switch due to ice formation thereupon.

For hand switching, the system 10 may be configured to dispense lubricant after a predetermined number of switchings have transpired; alternately, this may be manually actuated. Station 90 also has a primary nozzle 100 aimed to direct efficiency enhancement material(s) onto the switch plate 96 and secondary nozzles 102 and 104 to direct efficiency enhancement material to the tops of the rails a short distance before the switch points 106, 108. Alternately, station 90 may have a plurality of nozzles 100, each dedicated to the dispensing of a different type of efficiency enhancement material.

Preferably the secondary dispensers/nozzles are positioned to direct a flow of efficiency enhancement material at a point on top of the track that precedes the switch point by a distance approximately equal to the circumference of the wheel of a railroad car. When efficiency enhancement material is dispensed to the top of a track, the efficiency enhancement material will be picked up on the wheels of the next passing railroad car. Where the dispensing point precedes the switch point by approximately the circumference of a wheel, the wheels of the next passing railroad car will go through one revolution while picking up the efficiency enhancement material, after which they will transfer some of the efficiency enhancement material adhering thereto to the surface of the rail switch point, thereby lubricating or deicing the rail or switch point downtrack from the track portion originally receiving the efficiency enhancement material. A similar distribution of efficiency enhancement material may occur regarding the gauge faces.

A logic device, typically a microcomputer 62, initiates the operation of the pump to direct lubricant from the reservoir to the nozzles 100, 102, 104 upon receipt of a signal from one or more detectors 92, 94 indicative of movement of the switch plate 96. The station 90 will, therefore, lubricate and/or device the switch plate 96 and the switch points 106, 108 of switch 98 each time (or after a predetermined number of times) the switch is thrown. Alternately, the switch may be thrown manually, if desired, in response to the detector signals.

Figure 6:
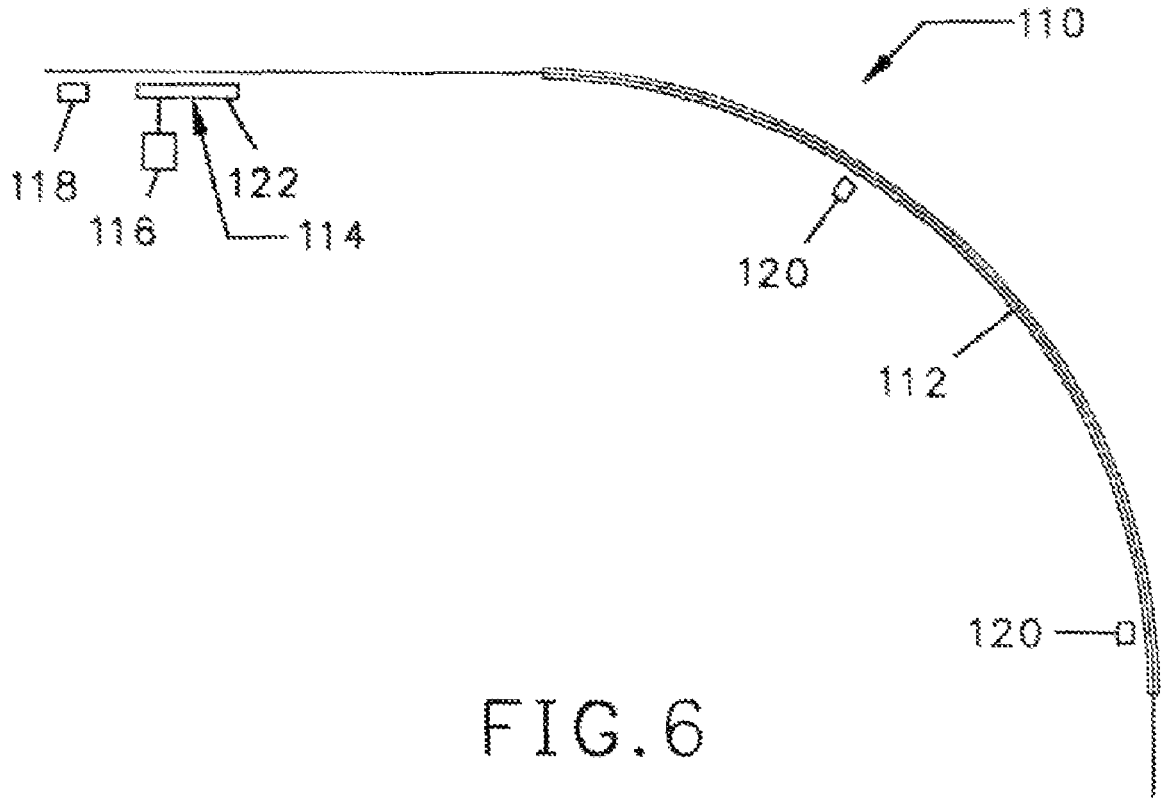
FIG. 6 is a schematic diagram of a length of main line track having a lubricating and feedback system in accordance with the present claimed technology attached thereto.

Referring now to FIG. 6, a length of railroad track 110 that extends through a curve 112 will typically undergo deterioration caused by the friction between the wheels of railroad cars and the track unless the track is adequately lubricated. To optimize the efficiency of rail car engagement with the track 110 through the curve 112, an efficiency enhancement system 114 is disclosed. Hereinafter, the lubrication function of the system 114 will be specifically discussed, but it should be noted that these specifics are equally applicable to deicing agents. The system 114 includes one or more reservoir(s) 116 of one or more types of lubricant, a first detector 118 for detecting the passage of a railroad wheel or axle with respect to a given point on the track 110, at least one down track vibration detector 120 (two of which are depicted), and a station 122 typically including a computer 123 (shown in FIG. 9). The vibration detector 120 may typically detect either acoustical vibration or vibration within the track 110.

Figure 7:
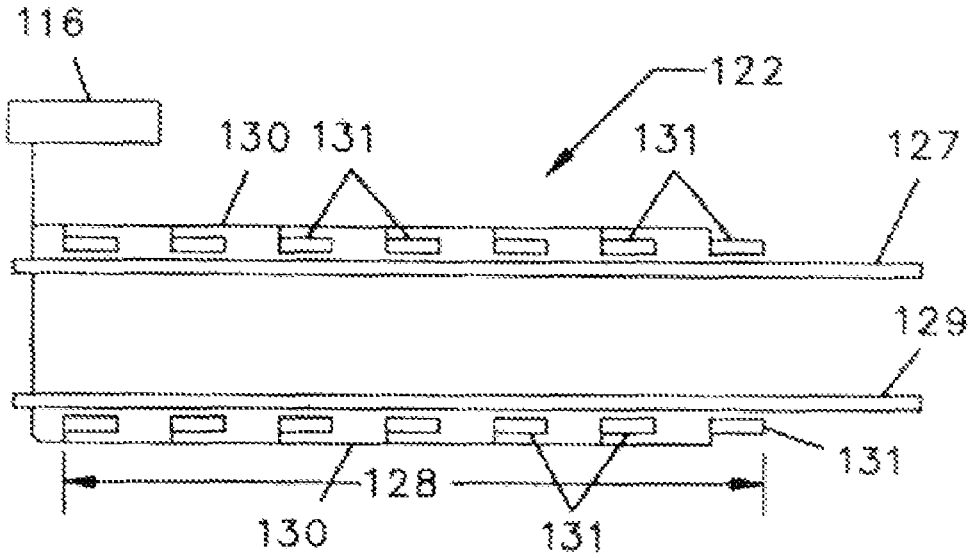
FIG. 7 is a schematic diagram of a station with a feedback system in accordance with the present claimed technology.
Figure 8:
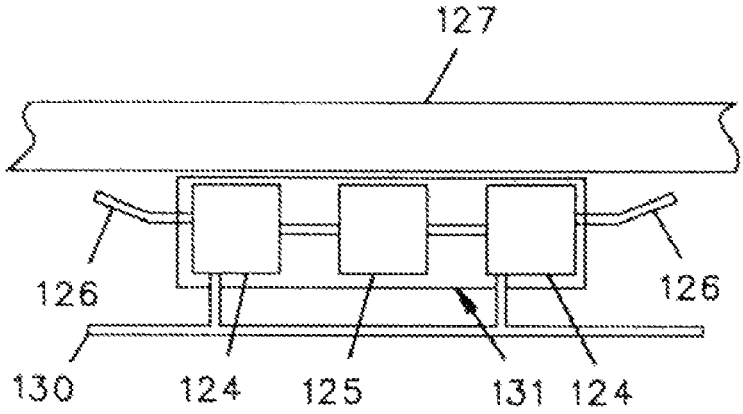
FIG. 8 is an enlarged schematic view of one of the motor, pump and nozzle modules which make up the station shown in FIG. 7.

Referring to FIGS. 7 and 8, the station 122 typically consists of a one or more pumps 124 driven by motors 125, wherein each pump 124 has an associated lubricant dispensing member 126. Each lubricant dispensing member 126 is typically a nozzle, and array of nozzles, a blade, or the like. The lubricant dispensing members 126 are positioned along a length 128 of the two rails 127, 129 of the track 110. Each of the pumps 124 is typically connected to the reservoir 116 by a feeder line 130 and the motors 125, the pumps 124 and dispensing members 126 form modules 131. The modules 131 are typically spaced a short enough distance apart along the length 128 of the track such that the entire length 128 of the track will be lubricated without interruption on unlubricated portions when the motors 125 are simultaneously actuated by the computer 123. The length 128 of track 110 is at least equal to the circumference of a wheel of a typical railroad car such that the movement of a wheel along the length 128 of a track will cause the entire circumference of the wheel to contact the lubricated surface of the track and transfer lubricant to the wheel. The subsequent rotation of wheels as the train moves down track through the curve 112 will cause the lubricant to migrate down to the portion of the track which constitutes the curve 112. Likewise, the wheel flange will carry lubricant along the gauge face.

Each lubricant dispensing member (illustrated herein as being a nozzle) 126 typically has associated therewith its own 124. The pumps 124 are typically of the type configured to dispense a predetermined amount of lubricant when energized, such as positive displacement pumps, such that the dispersal of lubricant through the nozzles 124 will be uniform and even throughout the length 128 of the track being lubricated. Furthermore, the use of positive displacement pumps enables the precise amount of lubricant to be applied regardless of changes in the viscosity or thickness of the lubricant as a result of temperature or of obstructions caused to individual nozzles 126. Were the nozzles 126 tied together so as to receive lubricant from a single pump 124, as was the case with the prior art, lubricant may be distributed unevenly through the nozzles. The uneven distribution of lubricant will become accentuated if one or more of the nozzles becomes blocked. In the event of a blockage of one nozzle 126, the pressure generated by the associated pump 124 associated with the blocked nozzle should typically free the obstruction. In the event the obstruction continues, however, excess lubricant typically will not be not be directed to the remaining nozzles.

Figure 9:
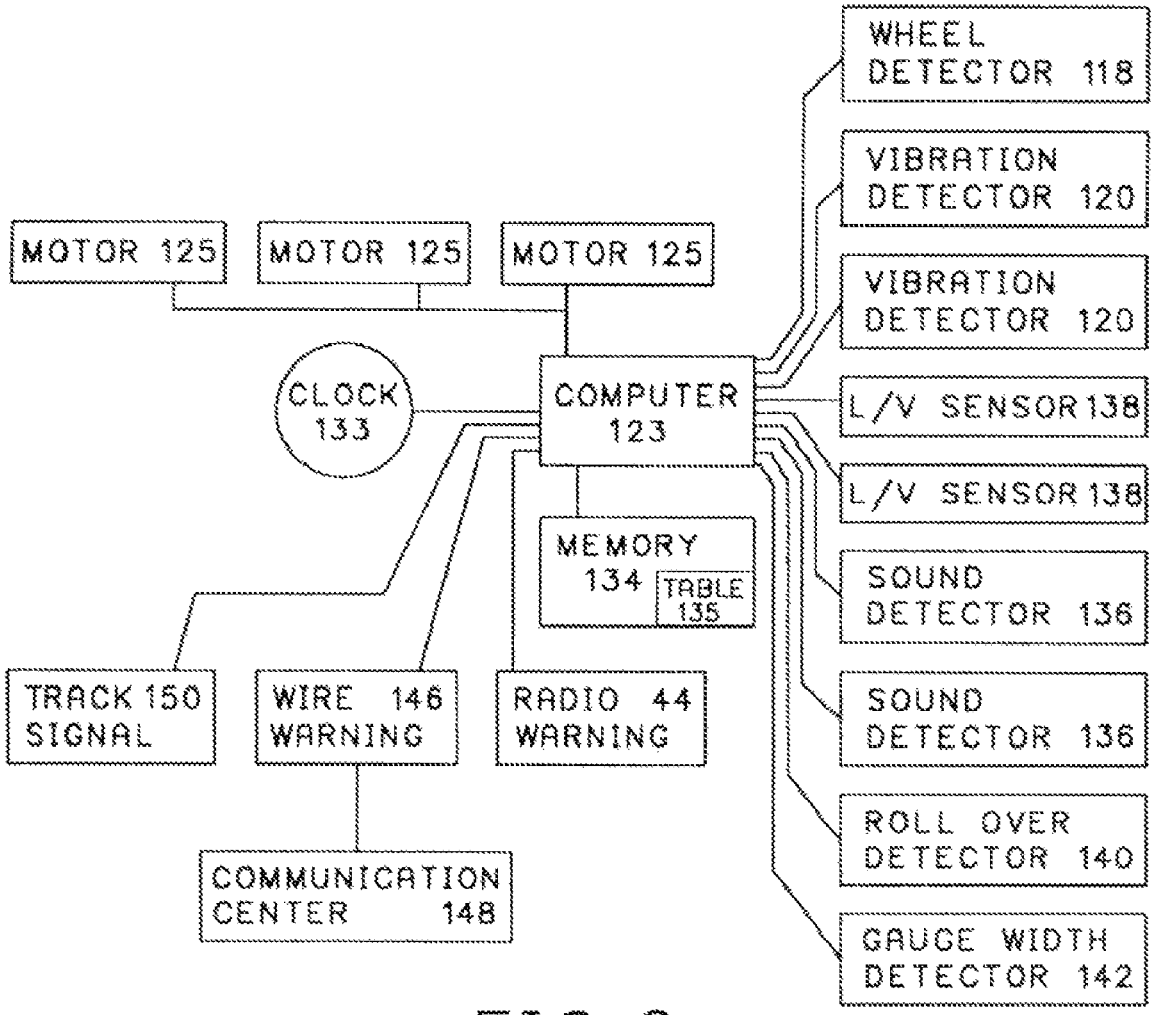
FIG. 9 is a block diagram of a control for the lubrication and feedback system shown in FIG. 7.
Figure 11:
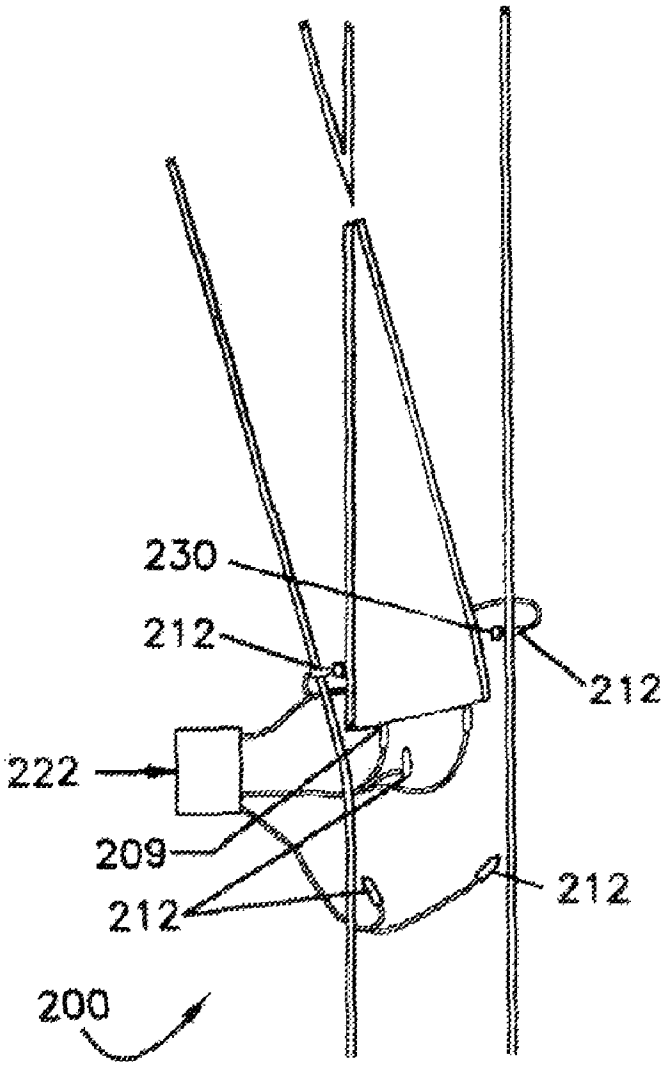
FIG. 11 is a schematic view of the embodiment of FIG. 10 as deployed at a railroad switch plate.
Figure 10:
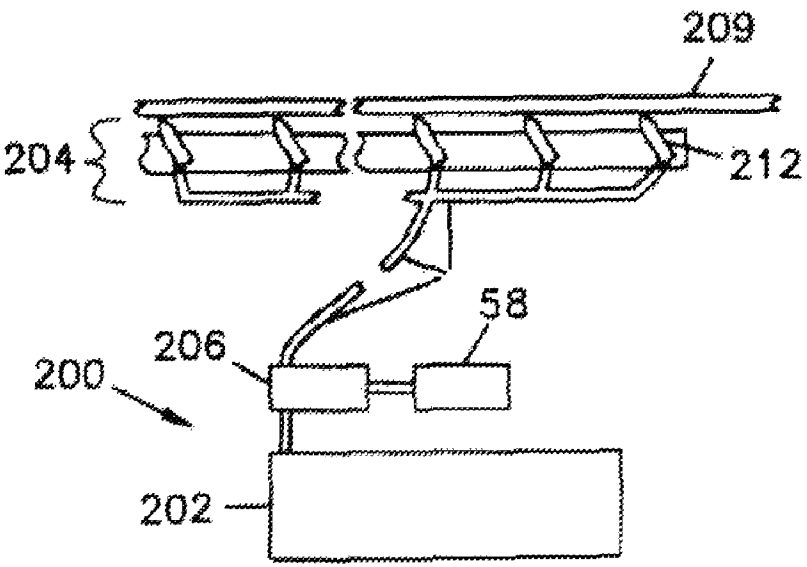
FIG. 10 is a schematic view of an automated railroad portion deicing system according to another embodiment of the present claimed technology.
Figure 12:
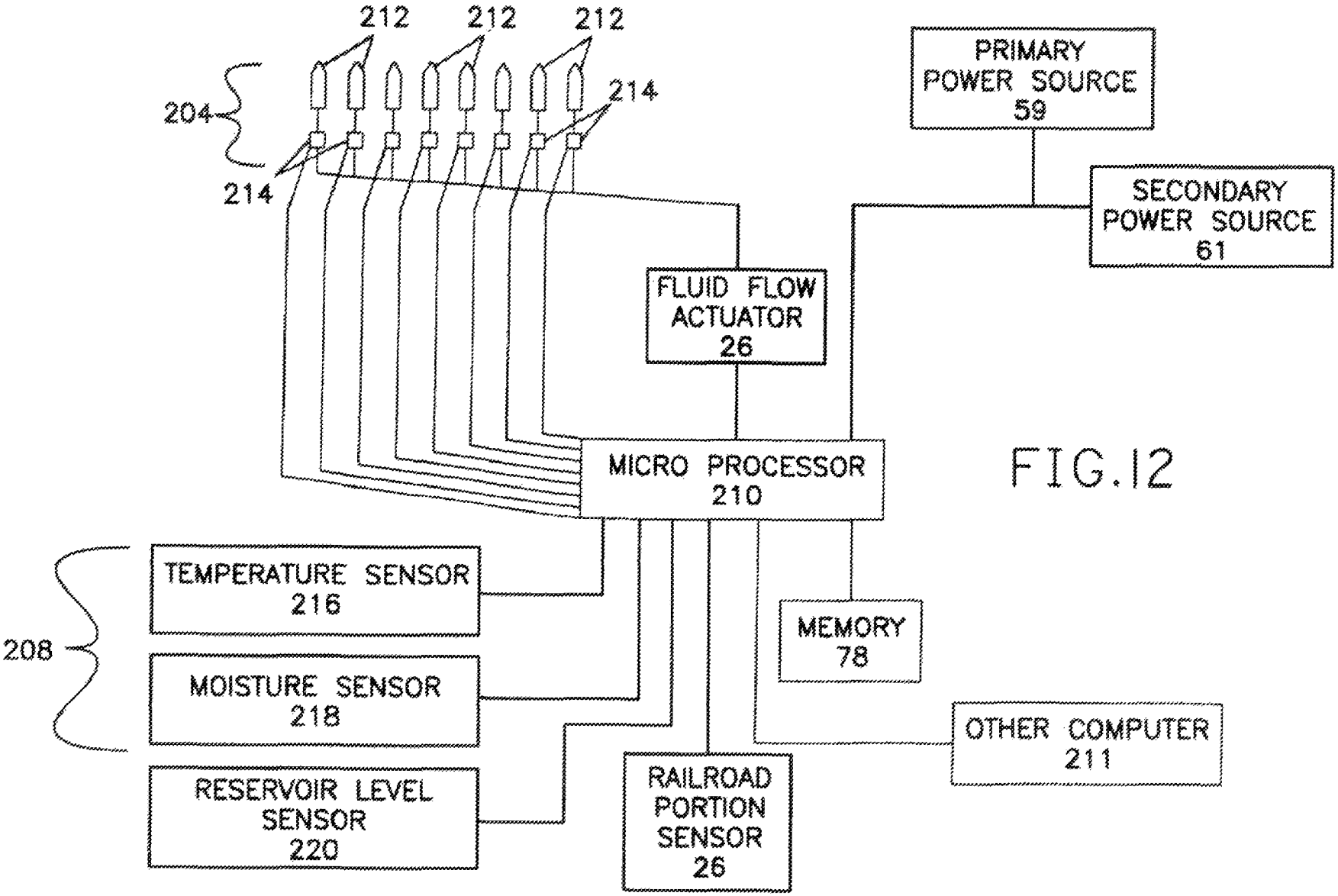
FIG. 12 is a schematic diagram of the control system for dispensing the deicer for the embodiment of FIG. 10.
Figure 13:
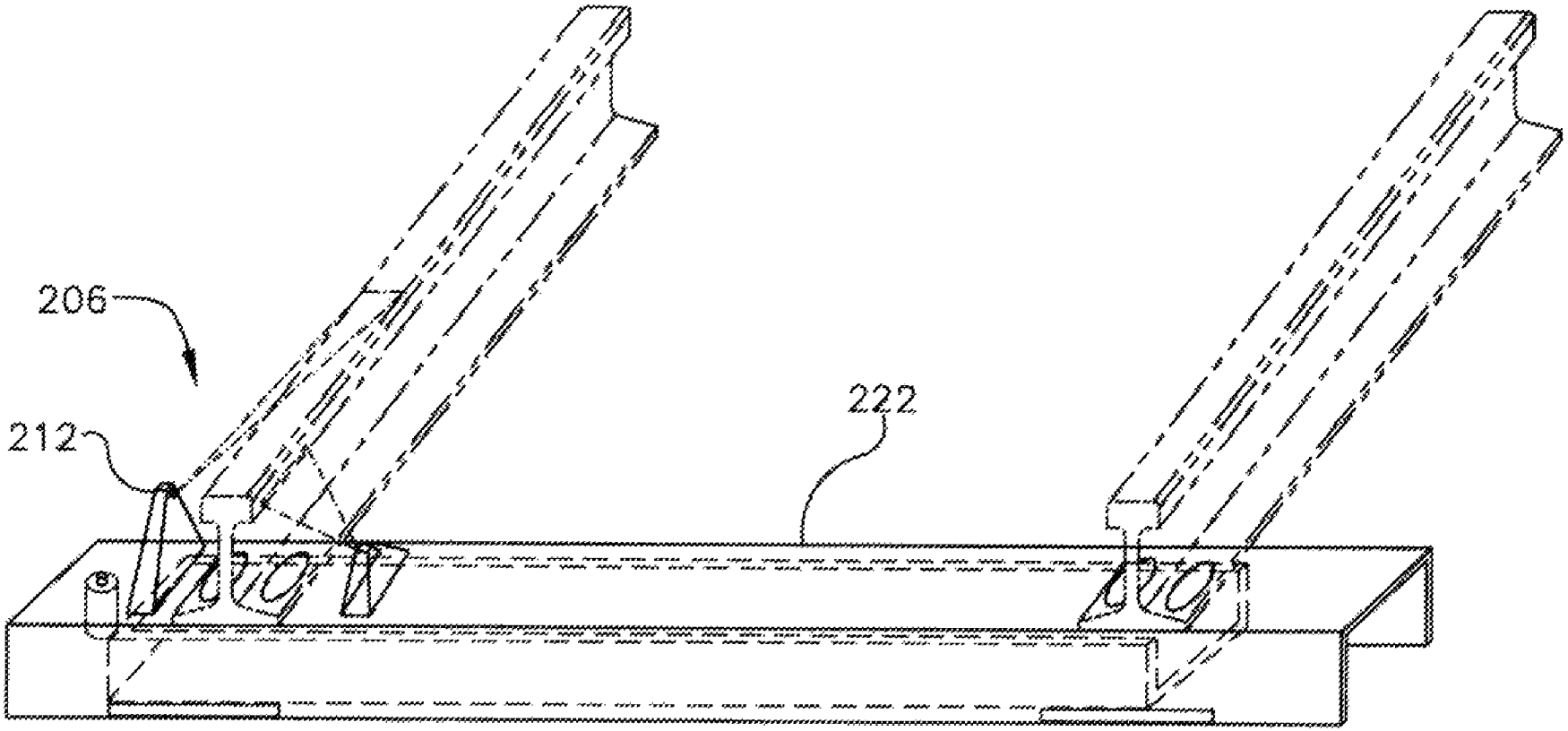
FIG. 13 is a schematic diagram of a railroad tie housing for the embodiment of FIG. 10.

Referring to FIG. 9, the computer 123 is typically configured to receive input from the vibration detectors 120 down track from the station 122 and from the first detector 118. The computer 123 typically includes a timing means such as a clock 133, a pair of spaced sensors, or the like, for measuring the time elapsing between successive wheels or axles on the trucks of the cars passing the detector 118 to determine the speed of the train. The determination of speed is reached by dividing the distance between the axles of the wheels on a truck of a railroad car and the time required for the successive axles of the truck to pass the first detector 118. A railroad car can be distinguished from the locomotive because the locomotive has three axles on each of its trucks whereas railroad cars have only two axles per truck.

The rolling of the wheels of a train across a track typically causes certain physical reactions which can be measured and vary principally as factors of train speed and the effective coefficient of friction of the track. Examples of such physical reactions which vary as factors of train speed and track friction are the maximum vibration frequency detectable within the track, the audio frequency (the screech or absence thereof) of sound generated by the wheels moving along the track, and the rate of lateral forces to the vertical forces (lateral/vertical) applied to the track, or the L/V ratio. For dry tracks, the effective coefficient of friction of the tracks generally correlates to the degree of lubrication of the tracks. These physical reactions can typically be measured and graphed for both lubricated tracks and unlubricated tracks as factors of train speed, and the results can be accumulated in a table of maximum acceptable reaction readings. By measuring train speed and one of these variable reactions, the measured reaction for a moving train can be compared with the maximum acceptable measurement in the table. When the measured reaction exceeds the maximum measurement indicative of a lubricated track, the track is not adequately lubricated and more lubricant should be applied to the track. When the measured reaction falls within the maximum measurement indicative of a lubricated track, the track is presumed to be adequately lubricated, and no more lubricant is needed.

It has been found that when a track has been adequately lubricated, for any given speed of a train crossing the tracks, the track will typically vibrate below a given maximum threshold. At higher speeds the acceptable maximum thresholds of vibration are higher than at lower speeds and the maximum thresholds can be recorded in a table as factors of train speed. The system, therefore, further includes a memory 134 in which is recorded a table of the accepted maximum vibration rates for each given speed of a railroad train passing across the track.

The computer 123 receives signals from the first detector 118 and the vibration detectors 20 and uses the information plus that in the memory 134 to determine the speed of the train and therefore the maximum acceptable vibration rates. The detected vibration rates are subsequently compared to the maximum acceptable rates stored in the memory 134. In the event the vibrations from the detectors 120 exceed the maximum acceptable rate or rates, the computer 123 will direct the pumps 124 to begin applying lubricant to the tracks 110.

As previously stated the need for lubrication is different for a gauge face lubricant than for a top of track lubricant. A gauge face lubricant is intended to protect the rail from wear from the locomotive and/or car wheel flanges and therefore it is desirable to apply a gauge face lubricant prior to the passage of every locomotive. On the other hand, a top of track lubricant protects the rail and rail car wheels from wear, but it inhibits the efficiency of the locomotive and should only be applied after the locomotive has passed.

When a long train is passing the curve 112, the lubricant applied to the tracks is moved by the wheels across the entire curve 112. In that event, the vibration detectors 120 will detect a reduction in the vibration rate to below the maximum threshold and the computer 123 will terminate power to the motors 125, and therefore pumps 124 thereby terminating the application of lubricant. In the event the vibration detector 120 does not detect a reduction in the vibration rate, the computer 123 will continue to direct power to the pumps 124 until the computer 123 determines from input from the first detector 118 that the last car has passed. Power to the pumps 124 will then terminate.

When a subsequent train approaches the lubricating station 122 the computer 123 will recall that the track 110 is inadequately lubricated and will again direct power to the pumps to apply lubricant to the track 110. (As previously stated, for top of rail lubricants, the application of further lubrication will be delayed until the locomotive has passed the station.) The computer 123 will continue to direct power to the pumps 124 to cause further lubrication of the tracks 110 until the vibration rate of the tracks, as determined by the detectors 120, falls below the maximum acceptable rate for the speed of the train as recorded in the memory 134, after which power to the pumps 124 will be terminated.

As an alternative to the vibration detectors 120, audio sound detectors 136 may be used to detect the vibration rate generated by the contact of the wheels of the train to the track 110. A railroad car moving across an unlubricated curved track generates an unpleasantly sharp screech, which is not the case for a railroad car moving across lubricated curved track. Thus, proper lubrication not only serves to extend the life of the cars, wheels, and tracks, but also contributes to a reduction of noise pollution in general and train screeches in particular.

As an alternative to measuring the vibration in the track 110, a L/V sensor 138 operable to detect lateral/vertical force ratios may be used to monitor the need for lubricate on the curve 112 of the track 110. When a train moves through a curve lateral forces are applied to a track and a greater force is applied to the track when the train is moving at a high speed than at a lower speed. On the other hand, for a given speed of a train, a greater lateral force is applied to an unlubricated track than to a lubricated track. Accordingly, the memory 134 of the computer 123 has stored therein the maximum acceptable ratios of lateral forces to vertical forces for each speed of the train. The computer compares the L/V ratios from the down track sensors 138 with the acceptable maximum for a given speed as recorded in the memory 134 of the computer 123. In the event the maximum L/V ratio is exceeded, the computer 123 will direct power to the pumps 124 to apply lubricant to the top and/or the gauge face of the track 110. The computer will continue to direct power to the pumps until the L/V ratio falls back to within acceptable perimeters or until the cars of the train are no longer passing the lubricating station 122. The further application of lubricant to the track 110 after the train has passed will cause excess lubricant to be deposited on the tracks.

Similarly, defective cars may be detected by installing a section of curved track 112 leading into a switchyard or the like, and positioning sensors 138 connected to a computer 123 to detect and categorize the sounds or vibrations produced by the cars traveling through the curve 112. The lubrication of the track 112 is maintained such that all cars traveling thereover experience substantially the same friction conditions. The analysis is similar to that descried above, except that instead of signaling for the application of more lubricant in response to an out-of-range L/V signal, sound pitch signal, vibration signal or the like, the computer 123 instead generates a message that the car traveling through the curve is potentially defective. Moreover, it is possible to categorize the character of the out-of-range signal to indicate what is probably the cause of the defect (spring wear, wheel flattening, etc. . . . ) and generate a specific message regarding the same.

Referring to FIGS. 7 and 8, in the preferred embodiment, each nozzle 126 and its associated pump 124 will comprise a single module 131 which is typically individually attachable to the length of track 110. Modular motorized pumps are presently available consisting of a pair of positive displacement pumps 124 driven by a single controllable motor 125, such as a stepper motor. By attaching one nozzle 126 to each of the pumps 124, one directed toward each end of a module 131, the number of modules needed to lubricate a length 128 of rail is equal to half the number of nozzles 126 needed to provide the desired lubrication.

The claimed technology may further include a rollover detector 140 for detecting a change in the angle of the track and a gauge width detector 142 for detecting a change in the width of the gauge of the track for detecting potential track failure. A warning may be sent by radio 144 to an approaching train, or across a wire 146 to a communications center down track 148, or to a track signal system 150.

FIGS. 10-13 relate to another embodiment of the present claimed technology, a railway deicing system 200 for the automation of chemical railway deicing techniques, such as those employed in aircraft operation and manual track applications. As used herein, the language 'deicing' encompasses not only the removal of preexisting ice/snow, but also the prevention of the accumulation of ice/snow. The system 200 includes a reservoir of deicing fluid 202, a deicing fluid dispensing assembly 204 connected in hydraulic communication with the reservoir 202, and a deicing fluid flow actuator 206 operationally connected to the reservoir 202. The system 200 also typically includes at least one ice sensor 208 positioned at or near a portion of the railroad system 209 desired to be deiced or kept free of ice to report the temperature thereof. The portion of the railroad system 209 to be deiced may be a length of track, a length of rail, a switch, a switch plate, a derail, switch rods and stands, walkways, or the like.

The system 200 further includes a microprocessor 210 connected in electric communication with the sensor 208 and the deicing fluid flow actuator 206. The microprocessor 200 is typically adapted to receive electrically communicated information, and more typically electric communication includes the reception of radio frequency (RF) signals. In other words, the microprocessor 210 is typically capable of wireless communication. More typically, the system 200 includes at least one valve 214 operationally connected to the deicing fluid dispensing assembly 204 and connected in electric communication with the microprocessor 210. Still more typically, the microprocessor 210 is electrically connected to another computer 211, which is typically a central computer 211 tasked with coordinating several such microprocessors 210. Further, remote intervention such as activation, status and/or alarm monitoring may be employed from devices in electric communication such as microprocessors, laptop computers, personal digital assistants (PDAs), cellular telephones, CE devices, or the like. Alternately, the automated system may be manually overridden to actuate flow of lubricant/deicer.

The deicing fluid dispensing assembly 204 may be of a blade type or may comprise one or more nozzles 212. More typically, the deicing fluid dispensing assembly 204 includes an array of nozzles 212. The nozzles 212 are typically positioned sufficiently close to one another such that, when energized, the deicing fluid flow actuator 206 may supply an adequate amount of deicing fluid to the deicing fluid dispensing assembly 204 to apply a continuous path of deicing fluid to the railroad portion desired to be deiced. It should be noted that the viscosity and other properties of the deicing fluid may change with temperature; thus, the amount of deicing fluid being supplied by the deicing fluid flow actuator 206 may be temperature dependent in some system configurations. Thus, it is preferable that the deicing fluid flow actuator 206 be adapted to supply a constant amount of deicing fluid independent of the temperature of the deicing fluid, deicing fluid flow actuator 206 and/or railroad portion such that the desired amount of deicing fluid will be ejected through the deicing fluid dispensing assembly 204 on each application.

One type deicing fluid flow actuator 206 adequate for the job is a positive displacement pump. Another type of deicing fluid flow actuator 206 adequate for the job is a pressurizer operationally connected to the reservoir 202 such that the reservoir 202 is substantially constantly pressurized and connected to the deicing fluid dispensing assembly 204; in this configuration, one or more solenoid valves 214 are connected to the fluid dispensing assembly (in the case of a plurality of nozzles 212, a solenoid valve 214 may be connected to each respective nozzle 212 or to a group of nozzles 212) and to the microprocessor 210 such that the valves 214 are selectively and independently controlled and sequenced by the microprocessor 210. Alternately, the pressurizer 206 may be a movable tie that can provide pressurization to the reservoir 202 by transducing the displacement of the tracks as the train passes over them.

The ice sensor 208 may be a unitary sensor for detecting frozen water or may be a combination of a temperature sensor 216 and a moisture sensor 218. Typically, a number of ice sensors 208 are deployed on or near the railroad portions 209 desired to be kept free of ice buildup. More typically, the ice sensor 208 includes an RF transmitter in wireless communication with the microprocessor 210. Typically, the system further includes a reservoir level sensor 220 (connected in electric communication with the microprocessor 210) for measuring the deicing fluid level remaining in the reservoir 202

The deicing fluid filling the reservoir 202 is typically chosen from formulas known in the art, such as the NASA/AMES developed ICE FREE SWITCH® (registered to Midwest Industrial Supply, Inc., P.O. Box 8431, Canton, Ohio, 44711) or any convenient deicing/antifreeze liquid or composition.

Thus, through the use of appropriately placed sensors 208, 216, 218, computer 210 monitoring and control, wireless communication to the selected de-icing components/locations and the use of a deicing fluid, the entire system 200 may be automated with metered application according to need. Depending on temperature variables, the system 200 could also use other deicing products. This allows for selective use from both a location and duration standpoint, thus significantly reducing unnecessary or excessive application of deicing fluid and resulting in the deicing process to be reliably available without subjective assessment and the need for human intervention.

Typically, the system 200 includes a plurality the above-described reservoir 202, deicing fluid dispensing assembly 204, deicing fluid flow actuator 206, ice sensor 208 and microprocessor 210 combinations as described above, located in substations 222 distributed near railroad portions 209 identified as requiring occasional deicing and connected via the central computer 211. Each substation 222 may include utility building to house the appropriate system 200 components. Alternately, a substation 222 may include a partially hollow railroad tie or ties 232, 242 (alone or in combination with each other) to house the appropriate system components. (See FIGS. 13 and 14). The ties 232, 242 may be modular and movable (see FIG. 13) or may be stationary and built into the tracks (see FIG. 14). Tie 242 may include the system 220 discussed above, or may include other gear, such as an energy recovery system 250 or the like. Still alternately, while the substation 222 is typically supplied with electric power a main power source 224, such as via power lines, the substation 222 may also include a second power source 226, such as a generator, a battery, a solar collector, kinetic energy transducer to convert motion of the train cars into electricity, or the like, to provide uninterrupted power in the event of a main power failure.

Since forecasts of weather conditions are general to an area that may be too large for reliably defining specific location needs, the system 200 employs sensors 208, 216, 218 typically located to define conditions at the actual served substations 222. This data is wirelessly available to a central computer 211 that frequently polls each substation 222 and processes this information against an algorithm that defines the need for de-icing on a substation 222-by-substation 222 basis. When a railroad portion 209 associated with a substation 222 meets criteria for de-icing, the microprocessor 210 electrically, and typically wirelessly, activates the energization of the deicing fluid flow actuator 206 to dispense deicer fluid to the specified track component 209 according to that components pre-defined quantity and frequency of application until the sensors 208, 216, 218 report that deicing is no longer indicated. Additionally, each substation 222 typically includes has a 'low material' indicator 220 that will cause an alarm condition at the central computer 211 indicating the need for refilling the reservoir(s) 202 at the different substation 222. This is a redundant safety factor since the central computer 211 typically also calculates the deicing fluid usage and schedules refilling of the reservoirs 202 accordingly. The central computer 211 and microprocessors 210 also will monitor the respective system 200 devices and call for the repair of any components identified as defective.

The deicing system 200 typically consists of the following components at each serviced location 222: a fluid storage reservoir 202, pump 206 and spray nozzle array 204 to dispense the de-icier, sensors for ice 208, moisture 218, track temperature 216, fluid level 220, railroad portion disposition 230 (i.e, switch position or the like), a wireless data transceiver and logic control unit 210, and a trackside enclosure 222 or specially constructed rail road 'tie(s)' 222 to house the above-mentioned components. The basic control system 232 functionally includes wireless and wired networking components 210, 211 (including the microprocessor 210 and central computer 211), programming loaded into the components 210, 211 to monitor, control and activate, report on and maintain records of the operation of serviced location components 202, 204, 206, 208 and the like, monitoring equipment and sensors 208 that may be polled for weather data, and selectable algorithms for deicing need determination and control. Other parameters that may be monitored by the microprocessor 210 are switch alignment, car counts, car movement/timing, wheel counts, barcodes, switch actuation and position, and the like, provided appropriate sensors are appropriately positioned and connected in electric communication to the microprocessor 210.

While the system 200 typically uses the 802.11 G wireless networking protocol, the control and monitoring and the communication paths are not limited to this wireless modality and could use almost any wireless connectivity (not limited to RF) or be hard wired with normal computer network wiring, such as coax, Cat. 5 or 6, fiber, and the like.

Main power 224 for the system 200 typically comes from the local grid via electrical power lines. Typically, a secondary power source 226 is provided, such as a back-up generator, a photovoltaic/storage battery power supply, or the like, may be added to establish an uninterrupted power source. Where more power is needed, perhaps for actual switching operation, an energy recovery system is described here. This system could be used for multiple applications not limited just to deicing or switching, but for things such as track lubrication and track crossing lights and/or gates at locations, station light and power, and the like, where the supply of normal electrical power distribution would be difficult or expensive. Further, on a larger scale this system could be used to augment commercial power and through time and cost amortization become a true co-generation system recovering 'waste' energy from the actual train operation.

There are many locations where rail tracks are frequently used by long and heavy trains. Due to the nature of the track construction there is a significant track deflection as each set of wheels roll by. Further, many of these locations (e.g., hump yards and switching centers) have electrical energy requirements of their own. This deflection may be transduced to provide useful 'found' energy, such as via mechanical, electromagnet, or like energy recovery system 250 means positioned therein.

For example, one system 250 for capturing this energy includes a series of hydraulic cylinders placed in specially constructed 'ties' and connected with the output fluid being transmitted via tubing to a hydraulic motor/flywheel assembly with check valves and fluid return tubing would cause this deflection to be converted into rotary energy that would be able to drive a generator.

Another system 250 would include a magnetic plunger traveling through a wire coil such that direct generation of electricity would result and through pooled wiring and diode isolation this electricity can be conditioned with a solid-state inverter/frequency synthesizer to be directly utilized.

Still another system 250, either alone or possibility in conjunction with the above, would include piezoelectric transducers connected to capture high frequency vibrations in addition to the mechanical deflection of the tie 242 for transduction into voltages that would be harnessed to generate current. (This might also be practical in a highway roadbed as a stand-alone method). Due to the variety of power requirements in this system and the loads to be served both alternating and direct current components can be used as efficiencies dictate.

In order for this type of energy recovery system to be practical, the electrical energy resultant from it would preferably be used locally (saving retail dollars) or connected to the utility grid (yielding wholesale dollars). One alternative would be through a storage system, which would likely be less cost efficient, unless used at a location that did not have economical access to commercial power such as a rural crossing gate, an isolated switch or a communications repeater site, etc.

Further energy may be recovered by likewise harnessing the 'slack' in the train. When traveling uphill, the cars tend to maximize the distance between themselves; when traveling downhill, the cars tend to minimize the distance between themselves. Electromechanical or electromagnetic energy generators may be installed between cars to transducer the kinetic energy of the cars moving relative one another into useful electrical energy that may be stored (either onboard the train or elsewhere) or fed into an electrical grid. Such energy may be used to supplement the train engine when traveling uphill to reduce energy usage and costs.

It should be noted that the microprocessors/computers 62, 123, 210 discussed herein, like virtually all microprocessors/computers, are inherently programmable. In most contemplated embodiments, the microprocessors 62, 123, 210 are used in the field and are thus field programmable. It is envisioned that an intelligent entity or 'user' performs the programming and, as part of that programming, defines the input values and parameters during the coarse of the programming; such input parameters include time duration, threshold levels, and the like. Thus, the microprocessors 62, 123, 210 are inherently field programmable means for enabling the application of friction modifiers and/or deicing agents for a user defined, field programmable duration in response to user defined, field programmable parameters, such as car speed (which may be measured by the sound or pitch of the train, vibration of the rails, Doppler shift of reflected sound or EM waves from the moving train, or simply by counting the passage of wheels per unit time past a fixed point, or the like), track conditions, weather conditions, or the like.

While the claimed technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the claimed technology are desired to be protected.

What is claimed:

1. A method of enhancing the efficiency of rail car engagement with the top and/or gauge face portions of a rail portion of a railroad system, comprising the steps of:

filling a reservoir with efficiency enhancing material;

connecting a pump in hydraulic communication between the reservoir and an efficiency enhancing material dispensing member;

positioning the efficiency enhancing material dispensing member along a rail portion substantially equal in length to the circumference of a railroad car wheel to provide a substantially continuous flow of efficiency enhancing material substantially equal in length to the circumference of a railroad car wheel onto the rail portion when the predetermined quantity of efficiency enhancing material is dispensed; and dispensing a predetermined quantity of efficiency enhancing material through the dispensing member;

wherein the power source is selected from the group including a solar panel, and electrical generator, an electric power grid, a battery, and combinations thereof; and wherein the electrical generator transduces a portion of the kinetic energy of a moving rail car into electricity.

2. A system for increasing the efficiency of the movement of a railroad car over a length of rail, comprising:

a fluid reservoir;

a quantity of efficiency enhancing fluid at least partially filling the reservoir;

a fluid dispensing member;

a fluid pump connected in fluidic communication between the reservoir and the fluid dispensing member for dispensing a predetermined quantity of fluid through the fluid dispensing member;

a microprocessor operationally connected to the fluid pump; and a first sensor for generating a first sensor signal in response to a railroad car crossing a predetermined section of track and operationally connected to the microprocessor;

wherein the fluid dispensing member is positioned along a railroad portion substantially equal in length to the circumference of a railroad car wheel to provide a substantially continuous flow of efficiency enhancing fluid substantially equal in length to the circumference of a railroad car wheel onto the rail portion when the predetermined quantity of fluid is dispensed; and wherein the sensor measures the pitch of sound made by a moving railroad car engaging a rail.

* * * * *